US006211750B1

(12) United States Patent
Gould

(10) Patent No.: US 6,211,750 B1
(45) Date of Patent: Apr. 3, 2001

(54) COAXIAL WAVEGUIDE FEED WITH REDUCED OUTER DIAMETER

(76) Inventor: Harry J. Gould, 1649 E. Hale St., Mesa, AZ (US) 85203

( * ) Notice: Subject to any disclaimer, the term of this patent is extended or adjusted under 35 U.S.C. 154(b) by 0 days.

(21) Appl. No.: 09/234,875

(22) Filed: Jan. 21, 1999

(51) Int. Cl.[7] ..... H01P 1/16; H01P 5/12

(52) U.S. Cl. ..... 333/21 A; 333/135; 343/756

(58) Field of Search ..... 333/21 A, 125, 333/126, 135, 137, 251; 343/756, 786

(56) References Cited

U.S. PATENT DOCUMENTS 5,245,353 9/1993 Gould ..... 347/786

5,459,441 10/1995 Weber et al. ..... 333/136

*Primary Examiner*—Robert Pascal
*Assistant Examiner*—Kimberly E. Glenn
(74) *Attorney, Agent, or Firm*—Parsons & Goltry; Robert A. Parsons; Michael W. Goltry

(57) ABSTRACT

Coaxial waveguide apparatus for conducting radio signals within a range of frequencies including an waveguide having an open end and a rear wall opposite the open end positioned along an axis of the waveguide and defining a waveguide cavity with a fundamental waveguide mode within the waveguide. The waveguide is constructed with a cutoff frequency for the fundamental waveguide mode which is at least 95% of the lowest frequency for the apparatus. A center conductor is positioned within the waveguide cavity and along the axis of the waveguide so that the center conductor and the waveguide define a coaxial waveguide cavity.

20 Claims, 4 Drawing Sheets

COAXIAL WAVEGUIDE FEED WITH REDUCED OUTER DIAMETER

FIELD OF THE INVENTION

This invention relates to antenna receiving apparatus for receiving or transmitting radio signals, and more particularly to waveguide feeds for receiving or transmitting orthogonally polarized radio signals.

BACKGROUND OF THE INVENTION

Parabolic as well as other circularly shaped reflectors are typically used in satellite communications for receiving radio signals from or transmitting radio signals to satellites. When receiving signals, the reflectors are used to gather incoming signals and then reflect them to a region, designated as the focal point, where the signals are concentrated and received by the antenna feed. Reciprocally, when transmitting signals, the signals are transmitted first through the antenna feed, after which, the signals disperse in such a manner as to illuminate the reflector, after which, the signals are directed by the reflector towards a satellite or other target. For simplicity the following discussion will be in terms of the antenna used to receive signals.

Because of the heavy demand for signal bandwidth, it has become a practice in the industry, in particular satellite to ground transmissions, to double the available bandwidth by simultaneously transmitting orthogonal signals. This can be accomplished by transmitting electric fields, which are linearly polarized as would be the case for a first bandwidth, which is vertically polarized, and a second bandwidth, which is horizontally polarized. Likewise, the two bandwidths can be elliptically or circularly polarized with a first bandwidth with clockwise polarization and a second bandwidth with counter-clockwise polarization.

A waveguide feed operating as an antenna feed commonly consists of a waveguide cavity to gather the signals which have been concentrated by the reflector and a probe or probes to couple the signals from the cavity to a circuit board which will usually have electronic devices to amplify and process the signals.

In many instances, as in the case for a coaxial waveguide feed, two frequencies are supplied to a single feed through the use of two probes aligned with the electrical fields of orthogonal $TE_{11}$ coaxial waveguide modes. However, care should be taken to ensure that the probes are not aligned with the electric fields of the TEM mode. By coupling to the TEM mode the probes couple to each other, which causes them to have poor polarization isolation. The alignment of the probes needs to be such that they excite the primary coaxial waveguide mode, $TE_{11}$, while suppressing the excitation of the TEM or coaxial mode.

In order for a single probe in circular shaped coaxial waveguide to be perfectly orthogonal to the TEM mode it would have to be circular in shape with perfect symmetry. There is no such shape that can also be used to excite the $TE_{11}$ mode. A common method is to use multiple probes or probes oriented in a complementary fashion. If complementary probes are excited with equal amounts of power but with a 180° phase difference, the $TE_{11}$ waveguide mode will be excited with no excitation of the TEM mode. A similar excitation of orthogonal complementary probes will likewise excite a second but orthogonal $TE_{11}$ mode with no excitation of the TEM mode. Such a scheme is complicated and, when receiving weak satellite signals, the necessary higher losses results in higher noise figures.

Many of the newer satellites transmit multiple bandwidths, which vary considerably in frequency. A good example is the use of the C-Band (typically 3.7 GHz to 4.2 GHz) and the Ku-Band (typically 11.7 GHz to 12.7 GHz) bandwidths. With approximately a 3:1 frequency ratio between the bandwidths, both bandwidths can be simultaneously received by waveguide cavities that are co-located. This is accomplished by placing the Ku-Band waveguide cavity within and with its axis aligned with the C-Band waveguide, which has a cross-sectional dimension of approximately three times the size of the Ku-Band waveguide.

While this co-location of waveguide cavities reduces the overall area required by the antenna feed, it is still rather large and cumbersome since each of the waveguide cavities is constructed as an individual or stand-alone cavity and they are then simply placed in axial alignment.

Accordingly, it would be desirable to provide a waveguide feed which overcomes this drawback.

It is an object of the present invention to provide a new and improved waveguide feed.

It is another object of the present invention to provide a new and improved waveguide feed with reduced external dimensions.

It is still another object of the present invention to provide a new and improved waveguide feed with reduced external dimensions which provides improved isolation and VSWR.

It is a further object of the present invention to provide a new and improved waveguide feed with a coaxial waveguide having a reduced outer dimension.

SUMMARY OF THE INVENTION

The above problems and others are at least partially solved and the above objects and others are realized in coaxial waveguide apparatus for conducting radio signals within a range of frequencies including a waveguide having an open end and a rear wall opposite the open end positioned along an axis of the waveguide and defining a waveguide cavity with a fundamental waveguide mode within the waveguide. The waveguide is constructed with a cutoff frequency for the fundamental waveguide mode which is at least 95% of the lowest frequency for which the apparatus operates. A center conductor is positioned within the waveguide cavity and along the axis of the waveguide so that the center conductor and the waveguide define a coaxial waveguide cavity, which will have a different fundamental mode than the above waveguide cavity.

Generally, at least one waveguide probe is mounted within said coaxial waveguide cavity so as to extend through either the waveguide or the rear wall into the coaxial waveguide cavity for exciting a first primary coaxial waveguide mode electromagnetic signal in the waveguide cavity. The waveguide probe is oriented to couple to a primary coaxial waveguide mode of the coaxial waveguide cavity and is further oriented to be substantially orthogonal to the TEM mode of the coaxial waveguide cavity. A second waveguide probe may be mounted within the coaxial waveguide cavity so as to extend through one of the waveguide and the rear wall for exciting a second primary coaxial waveguide mode electromagnetic signal in the waveguide cavity. The second probe is mounted orthogonal to the first probe and so that the second primary coaxial waveguide mode electromagnetic signal is orthogonal to the first primary coaxial waveguide electromagnetic signal and to the TEM mode of the coaxial waveguide cavity.

In a preferred embodiment of the present invention, the waveguide is constructed with a cutoff frequency for the fundamental waveguide mode in a range of 100% to 200% of the lowest frequency for the apparatus. In a specific example, the apparatus is constructed to conduct C-Band frequencies (typically 3.7 GHz to 4.2 GHz) and the waveguide is constructed to have an inner diameter in a range of approximately 2 inches to 1 inch.

BRIEF DESCRIPTION OF THE DRAWINGS

Referring to the drawings.

DESCRIPTION OF THE PREFERRED EMBODIMENTS

Figure 1:
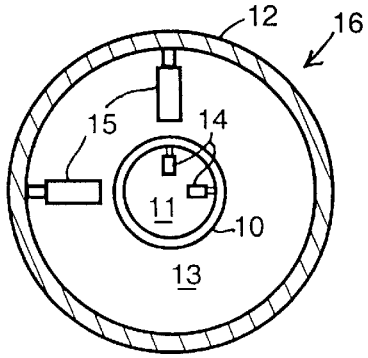
FIG. 1 PRIOR ART
FIG. 1 is a cross-sectional view of a prior art dual band coaxial waveguide feed.

Many of the newer satellites transmit multiple bandwidths, which vary considerably in frequency. A good example is the use of the C-Band (typically 3.7 GHz to 4.2 GHz) and the Ku-Band (typically 11.7 GHz to 12.7 GHz) bandwidths. With approximately a 3:1 frequency ratio between the bandwidths, both bandwidths can be simultaneously received by waveguide cavities that are co-located. Referring to FIG. 1, it can be seen that this co-location is accomplished by placing a Ku-Band waveguide 10 defining a cavity 11 within and with its axis aligned with a C-Band waveguide 12 defining a cavity 13. C-Band waveguide 12 has an inner diameter approximately three times the inner diameter of Ku-Band waveguide 10 as shown in FIG. 1. Waveguide 10 positioned within waveguide 12 forms a coaxial waveguide which is designated generally 16.

A pair of orthogonally oriented probes 14 are positioned in cavity 11 for transmitting or receiving Ku-Band signals and a pair of orthogonally oriented probes 15 are positioned in cavity 13 for transmitting or receiving C-Band signals. A waveguide orthomode-transducer (OMT) is often used in place of probes 14 shown in waveguide cavity 11. However, waveguide probes are often used in lieu of a waveguide OMT in cavity 13.

Figure 2:
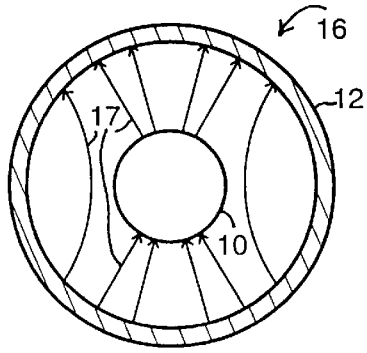
FIG. 2 is a cross-sectional view of the prior art coaxial waveguide feed of FIG. 1, portions thereof removed, illustrating a $TE_{11}$ or primary coaxial waveguide mode.

Referring specifically to FIG. 2, the alignment of electric fields (illustrated as lines 17 with arrowheads to indicate the polarity of the field) for a $TE_{11}$ or primary waveguide mode for coaxial waveguide 16. Coaxial waveguide 16 will support a second $TE_{11}$ mode (not shown), which is orthogonal to the first $TE_{11}$ but has its fields rotated 90 degrees relative to the fields shown in FIG. 2.

Figure 3:
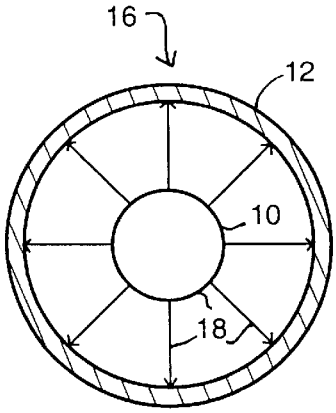
FIG. 3 is a cross-sectional view of the prior art coaxial waveguide feed of FIG. 1, portions thereof removed, illustrating the TEM or coaxial mode.

Turning now to FIG. 3, the alignment of electric fields (illustrated as lines 18 with arrowheads to indicate the polarity of the field) for the TEM mode of coaxial waveguide 16 is illustrated. The TEM mode is commonly referred to as the coaxial mode and, contrary to the nature of the $TE_{11}$ mode, only one TEM mode can exist in coaxial waveguide 16.

Returning to FIG. 1 with additional reference to FIGS. 2 and 3, it can be seen that probes 15 are aligned with the electrical fields 17 of a first and second orthogonal $TE_{11}$ modes. However, probes 15 are also aligned with electric fields 18 of the TEM mode. In this position it is obvious that probes 15 will couple to or excite both of the $TE_{11}$ and the TEM modes. By coupling to the TEM mode probes 15 will couple to each other, which will cause them to have poor polarization isolation. The coupling to the TEM mode will also cause beam squint and loss of efficiency when the waveguide apparatus is used as an antenna feed. The alignment of probes 15 needs to be such that they excite the primary coaxial waveguide mode, while suppressing the excitation of the TEM or coaxial mode.

Figure 4:
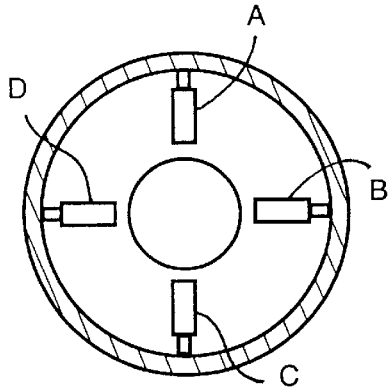
FIG. 4 PRIOR ART
FIG. 4 is a cross-sectional view of a prior art coaxial waveguide feed with multiple orthogonal complementary probes.

In order for a single probe to be perfectly orthogonal to the TEM mode shown in FIG. 3, it would have to be circular in shape with perfect symmetry. There is no such shape that can also be used to excite the $TE_{11}$ mode. A common method is to use multiple orthogonal complementary probes, which are shown in FIG. 4. If complementary probes A and C are excited with equal amounts of power but with a 180° phase difference, the $TE_{11}$ waveguide mode will be excited with no excitation of the TEM mode. A similar excitation of complementary probes B and D will likewise excite a second but orthogonal $TE_{11}$ mode with no excitation of the TEM mode. Such a scheme is complicated and, when receiving weak satellite signals, the necessary higher losses will result in higher noise figures. All of the probes of the A through D type in coaxial waveguide, lie along a plane that bisects the waveguide and as such are aligned with the fields of the TEM mode.

Figure 5:
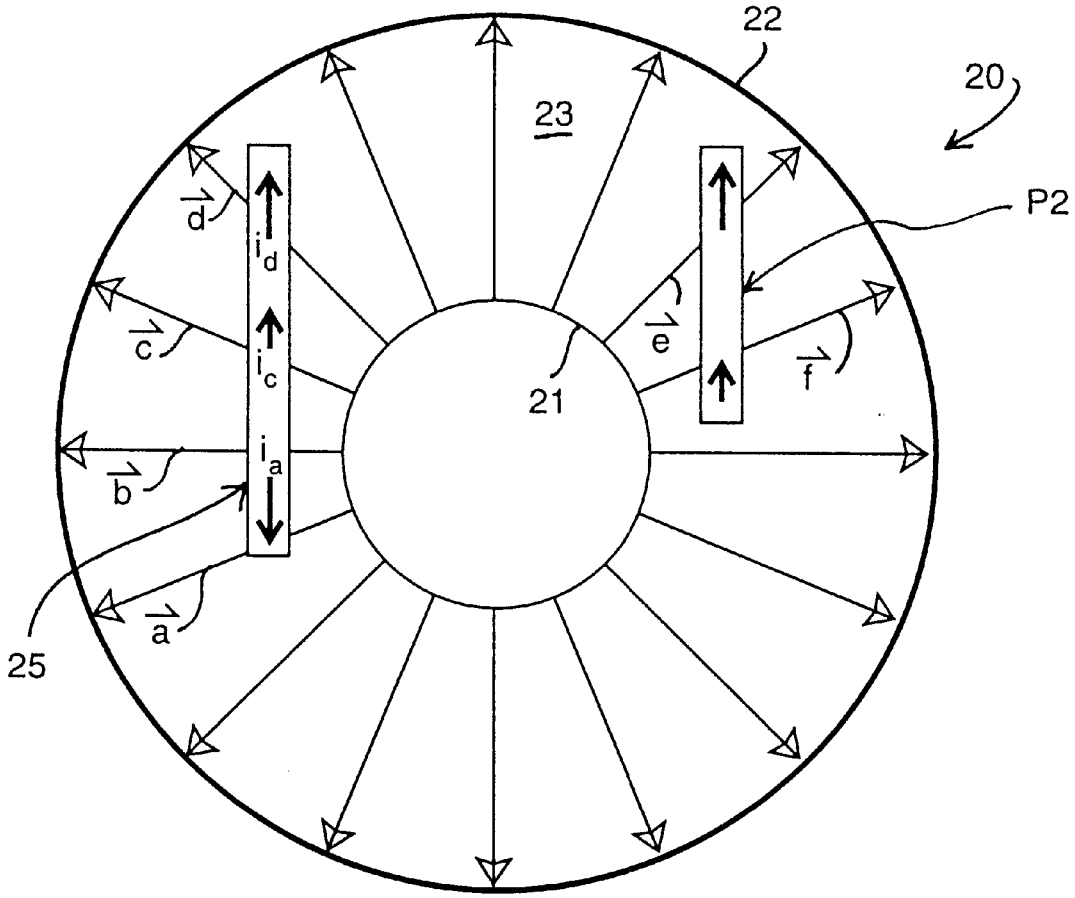
FIG. 5 is a cross-sectional view of a coaxial waveguide feed illustrating the placement of probes in alignment with the primary waveguide mode and orthogonal to the TEM mode.

Turning now to FIG. 5, a cross-sectional view of an coaxial waveguide 20 is illustrated in which an inner conductor 21 is coaxially positioned within an outer conductor 22 to define a waveguide cavity 23. Further, the alignment of the electric fields for the TEM mode of coaxial waveguide 20 is illustrated as lines 22 with arrowheads to indicate the polarity of the fields. The alignment of a probe 25, in FIG. 5 shows how a single probe can be positioned to be aligned with a $TE_{11}$ mode and to be orthogonal or non-aligned with the TEM mode. When an E-Field vector crosses a conductor or probe at an angle which is non-orthogonal to the probe it will excite electrical currents which flow along the probe. E-Field vectors can be resolved into x and y components, where one of the components is orthogonal to the probe while the other component is tangential to the probe. The tangential component will excite currents, which will flow along the probe.

In Probe 25, E-Field vectors a, c, and d excite currents $i_a$, $i_c$, and $i_d$, while a vector b, being orthogonal to probe 25, excites no currents. Current $i_a$ excited by vector a is opposed to currents $i_c$, and $i_d$, which are excited by E-Field vectors c and d. If current $i_a$ excited by E-Field vector a is equal and opposite in phase to currents $i_c$, and $i_d$, excited by E-Field vectors c and d, then Probe 25 is orthogonal to the TEM mode. Although, FIG. 5 demonstrates how a probe can be positioned to be orthogonal to an electro-magnetic field, the actual phenomenon is more complicated. The field intensity near center conductor 21 is more intense than the fields near outer conductor 22, and equal fields along probe 25 do not necessarily equally excite currents. For example, it may be easier to excite a current near the end of probe 25 then at the mid section or vice-versa depending on the impedances present. However, it is necessary that field vectors of the TEM mode are present which excite currents that oppose one another. A second probe 26 is illustrated which has some orthogonality to the E-Fields, but currents induced into probe 26 by tangential components (i.e. E-Field vectors e and f) all flow in the same direction. Probe 25 can be considered to be substantially orthogonal to the TEM mode while probe 26 is not substantially orthogonal.

The best and simplest way to position a probe is to align it while making electrical measurements. Often times after a set of dual waveguide probes are aligned for the optimum orthogonality or polarization isolation, they will not necessarily be mechanically positioned at an angle of 90° to each other. This is due to the fact that the asymmetrical presence of the probes upsets the symmetry of the waveguide structure and consequently the symmetry of the fields.

Thus, as described above, a coaxial waveguide feed can be utilized as a feed for a larger or primary antenna reflector, among other uses, and has both an outer conductor and an inner conductor, which together comprise a coaxial waveguide. A single waveguide probe is mounted within the coaxial waveguide and is oriented such that it couples to a primary coaxial waveguide mode while being orthogonal to the TEM or coaxial mode. A second waveguide probe can be mounted for coupling to a second primary coaxial waveguide mode, orthogonal to the first primary waveguide mode. The center conductor can also be utilized as a second waveguide antenna feed, which would operate at a higher frequency than would the larger coaxial waveguide.

In all of the prior art coaxial waveguide feeds or co-located waveguide cavities, such as for receiving C-Band and Ku-Band, the diameter of the outer conductor is approximately three times the diameter of the inner conductor when receiving frequency bands which are approximately 3:1. However, as will be described in detail below, the presence of the inner conductor allows the cross-sectional dimensions of the outer conductor to be smaller than the dimensions which would be allowable without the inner conductor. This reduction in the cross-sectional dimensions of the outer conductor allows the new and novel antenna feed to be utilized in tight fitting situations such as multi-beaming applications, where multiple antenna feeds are fitted to a single primary reflector.

Figure 6:
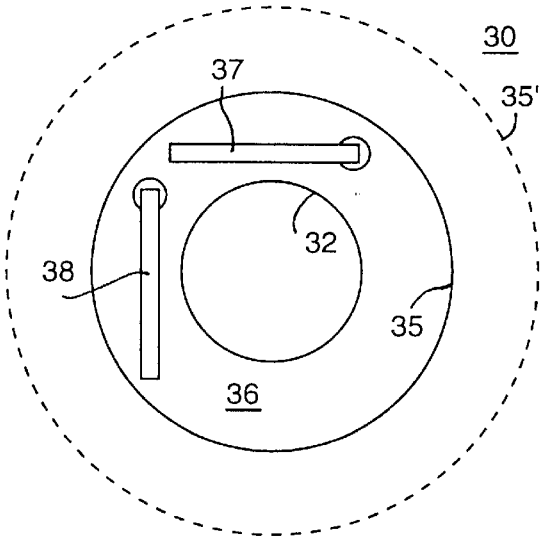
FIG. 6 is a cross-sectional view of a coaxial waveguide feed in accordance with the present invention.
Figure 7:
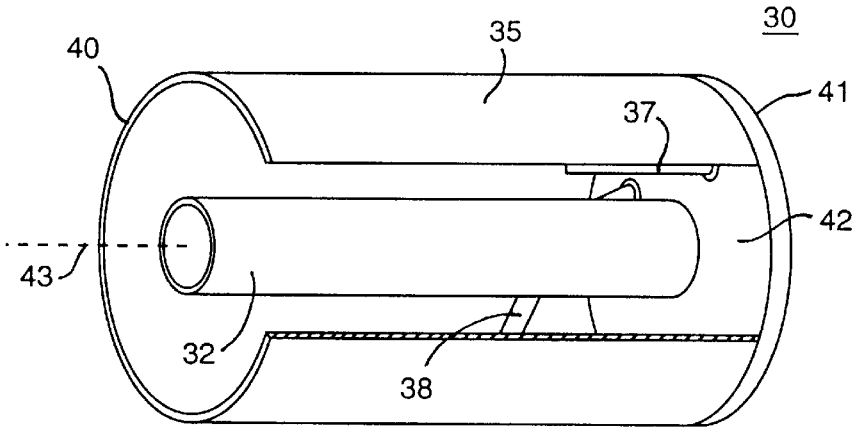
FIG. 7 is an isometric view of the coaxial waveguide feed of FIG. 6, portions thereof broken away.

Turning now to FIG. 6, a cross-sectional view of a coaxial waveguide feed 30 is illustrated. In this discussion it will be assumed for convenience that coaxial waveguide feed 30 is used for an antenna feed although it will be understood by those skilled in the art that many other uses are possible. Coaxial waveguide feed 30 includes an inner conductor 32 (or waveguide) and a coaxially mounted outer conductor 35 (or waveguide) defining a coaxial waveguide cavity 36 therebetween with a fundamental waveguide mode. Referring in addition to FIG. 7 which is an isometric view with portions broken away, it can be seen that outer conductor 35 is a waveguide with an open end 40 and an opposite end 41 terminating in a rear wall 42. Open end 40 and opposite end 41 are positioned along an axis 43 of coaxial waveguide feed 30. As will be explained in more detail presently, inner conductor 32 can be a solid conductor or it can be an waveguide defining a second waveguide cavity therein. A pair of orthogonal probes 37 and 38 are positioned in waveguide cavity 36 for exciting first and second primary coaxial waveguide mode electromagnetic signals in waveguide cavity 36.

In designing coaxial waveguide feeds, the engineer must select a waveguide size, which will accommodate certain desired waveguide modes. Most often the size of the waveguide is selected such that it is large enough to allow the fundamental waveguide mode to propagate, but small enough to suppress all of the other waveguide modes, which are referred to as higher order modes. For example, a waveguide feed, which is designed to receive the 3.7 GHz–4.2 GHz satellite transmission band (the C-Band), must be large enough to allow 3.7 GHz to propagate in the fundamental mode and small enough to suppress higher order modes at 4.2 GHz.

For circular waveguide as, for example, waveguide 35 (without center conductor 32), the minimum diameter needed to propagate the fundamental mode, $TE_{11}$, is determined by the equation, $$D=\lambda c/1.706 \quad \text{(I)}$$

where:

λc is the cutoff wavelength for 3.7 GHz, and

D is the diameter of the circular waveguide.

Using equation I, the diameter of a circular waveguide needed to propagate the fundamental waveguide mode at frequencies of 3.7 GHz and higher is 1.87 inches.

The first higher order mode is the $TM_{01}$ mode, which is allowed to propagate when the diameter of a circular waveguide is determined by the equation, $$D=\lambda c/1.3065 \quad \text{(II)}$$

where:

λc is the cutoff wavelength for 4.2 GHz, and

D is the diameter of the circular waveguide.

Using equation II, the diameter of a circular waveguide needed to propagate the $TM_{01}$ mode at frequencies of 4.2 GHz and higher is 2.15 inches.

With the above information we now know that, if we want a circular waveguide to propagate only the fundamental mode $TE_{11}$ from 3.7 GHz to 4.2 GHz, the diameter must be between 1.87 inches and 2.15 inches. Since it is difficult to match impedances when the diameter is close to the cutoff of the fundamental waveguide mode, the diameter selected needs to be closer to 2.15 inches rather than 1.87 inches.

Good engineering practice dictates that the diameter of the circular waveguide should be no larger than 98% of a diameter, which would allow a higher order mode to propagate at the highest frequency used in the band. It should also be at least 10% larger than the diameter at which the waveguide will no longer allow the lower band edge to propagate as a fundamental waveguide mode. Using these criteria, a diameter of 2.1 inches to 2.125 inches is a good selection. C-Band waveguide feeds currently in operation for the 3.7 GHz–4.2 GHz band have diameters close to 2.1 inches and are represented in FIG. 6 by waveguide 35' illustrated in broken lines. The diameter selected is determined by the upper band edge, $F_2$, and it's relationship to a first higher order waveguide mode and by the lower band edge, $F_1$, and it's relationship to the fundamental waveguide mode. A diameter of 2.1 inches converts to 0.747 λ at 4.2 GHz and 0.658λ at 3.7 GHz.

The cutoff frequency, $F_c$, for the fundamental mode for a 2.1 inch diameter circular waveguide (e.g. waveguide 35', which has a diameter approximately 3 times the diameter of center conductor 32) is 3.294 GHz. The ratio between $F_c$ and the lower band edge, $F_1$, is 3.294/3.7, which is 0.89, or the cutoff frequency is 89% of the lowest operating frequency. Here it should be noted that an $F_1$ equal to $F_c$ (a cutoff frequency approximately 100% of the lowest operating frequency) will not propagate in the circular waveguide.

By adding center conductor 32 to outer conductor 35, the circular waveguide becomes a coaxial waveguide. Coaxial waveguide feed 30 is also able to conduct the TEM mode which has no cutoff frequency and which is not considered a waveguide mode. With the diameter of outer conductor 35 being designated $D_a$ and the diameter of inner conductor 32 being designated $D_b$, for the condition where $D_a$ equals three times $D_b$, the cutoff wavelength for the fundamental coaxial waveguide mode $TE_{11}$ is determined by the following equation, $$\lambda c=1.873(\Pi/4)(D_a+D_b);\ D_a=3D_b.$$

The cutoff wavelength for the next higher order mode, $TE_{21}$, is determined by the equation, $$\lambda c=1.023(\Pi/4)(D_a+D_b);\ D_a=3D_b.$$

For a coaxial waveguide cavity with an outer diameter of 2.1 inches and with a 0.7 inch inner diameter, the cutoff frequency ($F_c$) for the fundamental mode, $TE_{11}$, is 2.865 GHz, while the cutoff frequency ($F_c$) for the first higher order, $TE_{21}$, mode is 5.246 GHz. For a circular waveguide (without the inner conductor) with a diameter of 2.1 inches, the fundamental mode, $TE_{11}$, cuts off at 3.294 GHz while the first higher order mode, $TM_{01}$, cuts off at 4.302 GHz.

It can be seen that coaxial waveguide feed 30 of FIG. 6 allows for a much broader-frequency operating range than that which is allowed by a circular waveguide feed. Thus, the outer diameter of coaxial waveguide cavity 36 is reduced so as to have a cutoff frequency ($F_c$) for the fundamental circular waveguide mode, $TE_{11}$, which is at least 95% of the lowest operating frequency for coaxial waveguide feed 30. More specifically, outer conductor 35 is preferably constructed so that coaxial waveguide cavity 36 has a cutoff frequency ($F_c$) for the fundamental circular waveguide mode, $TE_{11}$, which is in a range of 100% to 200% of the lowest operating frequency for coaxial waveguide feed 30. In a specific example, assuming coaxial waveguide apparatus 30 is designed for receiving or transmitting radio signals of C-Band frequencies and with an inner conductor of diameter 0.7 inches, outer conductor 35 is constructed to have an inner diameter (outer diameter of coaxial waveguide cavity 36) of less than 2 inches. More specifically, when coaxial waveguide apparatus 30 is designed for receiving or transmitting radio signals of C-Band frequencies, outer conductor 35 is preferably constructed to have an inner diameter in a range of 2 inches to 1 inch.

Thus, the present invention allows for the outer conductor of a coaxial waveguide to be smaller than that which would be allowed if the feed were designed for a circular waveguide without the inner conductor. It also allows for the use of waveguide probes which couple to the fundamental waveguide mode while having orthogonality to the TEM mode and which enter the waveguide cavity from either the rear wall or the side wall. The novel coaxial waveguide feed (e.g. feed 30) of the present invention can be used with a single probe (i.e. either probe 37 or 38) in coaxial waveguide cavity 36. A single probe will still have the advantage of exciting the $TE_{11}$ coaxial waveguide mode while minimizing the excitation of the TEM mode.

Figure 8:
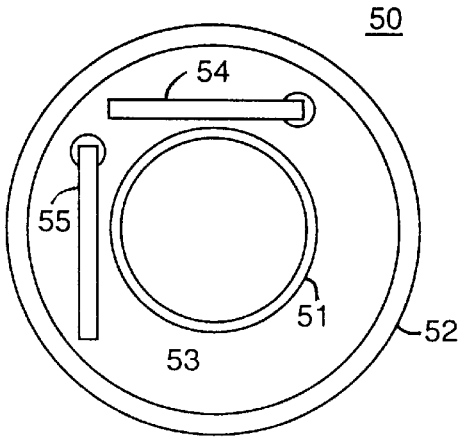
FIG. 8 is a cross-sectional view of a coaxial waveguide feed illustrating the placement of probes through the rear wall.
Figure 9:
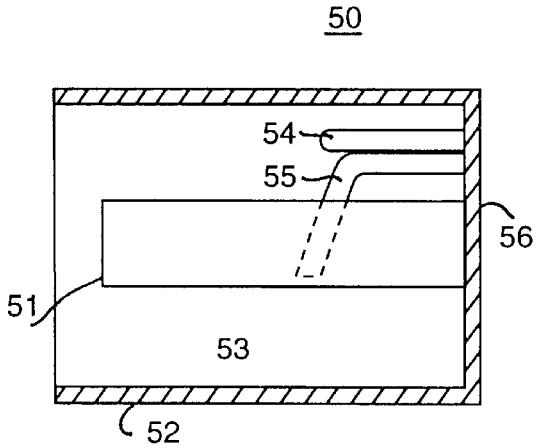
FIG. 9 is a longitudinal sectional view of the coaxial waveguide feed of FIG. 8.
Figure 10:
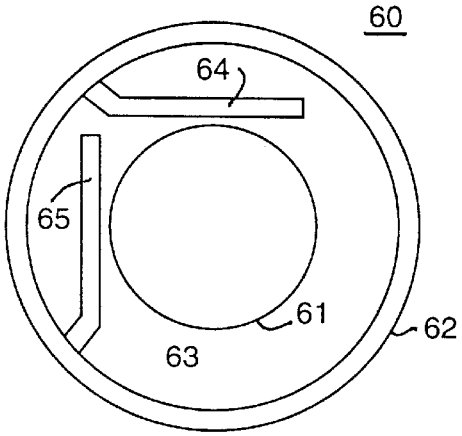
FIG. 10 is a cross-sectional view of a coaxial waveguide feed illustrating the placement of probes through the side wall.
Figure 11:
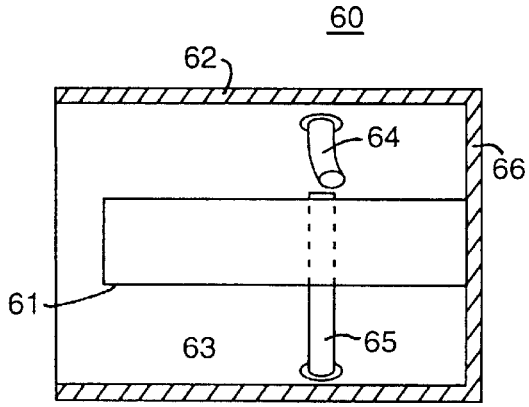
FIG. 11 is a longitudinal sectional view of the coaxial waveguide feed of FIG. 10.

The probe or probes enter the coaxial waveguide apparatus from either the backwall or from the sidewall. FIGS. 8 and 9 are cross-sectional and longitudinal sectional views, respectively, of a coaxial waveguide feed 50 having an inner conductor 51 and a coaxially positioned outer conductor 52 defining a coaxial waveguide cavity 53 therebetween. A pair of orthogonal probes 54 and 55 enter cavity 53 through a backwall 56. Having the probes enter from the backwall, as shown in FIGS. 6, 8, or 9 offers the advantage of allowing the probes to easily exit onto a single circuit board. FIGS. 10 and 11 are cross-sectional and longitudinal sectional views, respectively, of a coaxial waveguide feed 60 having an inner conductor 61 and a coaxially positioned outer conductor 62 defining a coaxial waveguide cavity 63 therebetween. A pair of orthogonal probes 64 and 65 enter cavity 63 through a sidewall of outer conductor 62. The side wall exit, as shown in FIGS. 10 and 11, offers the advantage of having exits with spatial distance and of allowing separate waveguide flanges if that is what is desired for a particular design.

Figure 12:
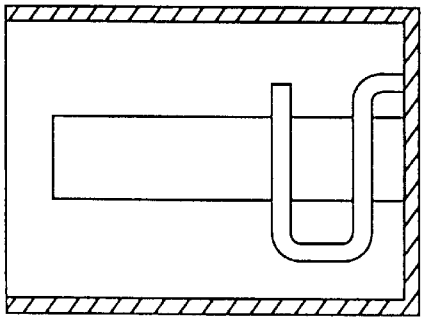
FIGS. 12 and 13 are longitudinal sectional views of coaxial waveguide feed with different shaped probes.
Figure 13:
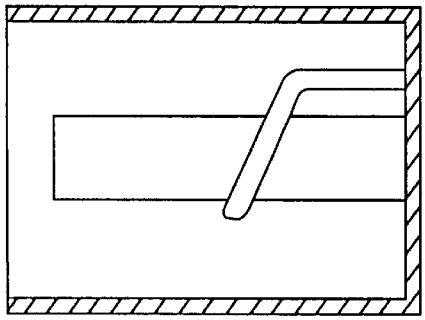
Figure 14:
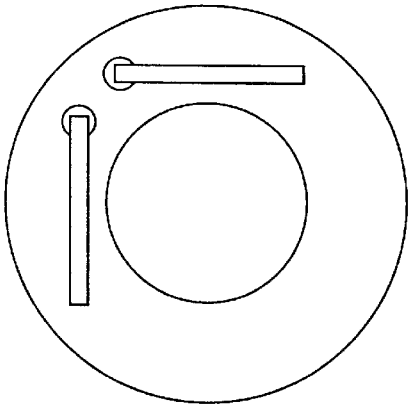
FIG. 14 is a cross-sectional view of a coaxial waveguide feed with probes entering the feed at adjacent entries.

Many different shapes of probes can be used to achieve high isolation from the TEM mode and good coupling to the primary waveguide mode. Referring specifically to FIGS. 12 and 13, two different shapes of probes that work well are illustrated. When using dual probes, the two probes can have different shapes and still perform well. The probes can also enter the waveguide in close proximity to each other as shown in FIG. 14, rather than as shown in FIGS. 8 and 10.

Referring again to FIG. 6 for example, inner conductor 32 of coaxial waveguide feed 30 can be a solid or a hollow conductor. In a further variation, inner conductor 32 can be a waveguide defining a circular waveguide cavity therein, which can then be used for a second band of frequencies. By converting inner conductor 32 into a second but smaller waveguide, coaxial waveguide feed 30 is commonly used to make a co-located feed for two separate frequency bands. Synchronous orbit satellites are commonly designed to transmit a C-Band at 3.7 GHz–4.2 GHz and a Ku-Band at 11.7 GHz–12.2 GHz. These frequencies have approximately the same 3:1 ratio used in the above discussion of coaxial waveguide feed 30. In this fashion, coaxial waveguide feed 30 can be used as a co-located feed to transmit or receive signals for both bands.

The common practice in the industry is to take a circular waveguide, which has a diameter that will accommodate a C-Band only feed, and add a smaller concentric waveguide for the Ku-Band signals. The wide spread between the fundamental mode and the next higher order mode allow the designer plenty of room to determine the diameter of the outer conductor for the C-Band, while the diameter of the smaller Ku-Band waveguide has the more stringent constraints of the circular waveguide.

It is becoming a common practice to install multiple feeds on a single reflector with each feed positioned to receive signals from different satellites. In some situations the positions of the feeds are so close to each other that they physically interfere with each other. The application of the present invention allows the feeds to be spaced closer than what is allowed with current designs. Further, the application of the present invention to the waveguide probes, as shown for example in FIG. 6, allows the probes to achieve a better matching condition and higher isolation between two orthogonally polarized probes.

Although the above discussions have centered on coaxial waveguides with circular shapes for both the outer conductor and the center conductor, it should be understood that the same principles apply to waveguides that may not be circular in shape. For example the outer conductor could be circular, square, rectangular, or some other shape while the inner conductor could be circular, etc. or vice-versus. Or, both the outer and inner conductors could be circular, square, or rectangular. The inner conductor can also be triangular or any other shape imaginable. Also, the center conductor does not need to contain a waveguide to apply the teachings of this invention.

While I have shown and described specific embodiments of the present invention, further modifications and improvements will occur to those skilled in the art. I desire it to be understood, therefore, that this invention is not limited to the particular forms shown and I intend in the appended claims to cover all modifications that do not depart from the spirit and scope of this invention.

What is claimed is:

1. Dual waveguide feed apparatus for conducting radio signals within dual ranges of frequencies including a lowest frequency, the apparatus comprising:

an outer conductor having an open end and a rear wall opposite said open end positioned along an axis of the outer conductor and defining a first waveguide cavity within the outer conductor,;

a center conductor positioned within said first waveguide cavity and along the axis of said outer conductor, the center conductor defining a second waveguide cavity with a fundamental waveguide mode within the center conductor, the second waveguide cavity being constructed to operate at a first range of frequencies; and said center conductor and said outer conductor defining a coaxial waveguide cavity with a fundamental coaxial-waveguide mode within the coaxial waveguide cavity, the coaxial waveguide cavity being constructed to operate at a second range of frequencies different than the first range of frequencies, and the outer conductor being constructed to have a cutoff frequency for the fundamental coaxial-waveguide mode which is at least 95% of the lowest frequency for the apparatus.

2. Apparatus as claimed in claim 1 wherein the outer conductor is constructed to have a cutoff frequency for the fundamental coaxial waveguide mode which is in a range of 100% to 200% of the lowest frequency for the apparatus.

3. Apparatus as claimed in claim 1 including in addition a first waveguide probe mounted within said coaxial waveguide cavity for exciting a first primary coaxial waveguide mode electromagnetic signal in the waveguide cavity.

4. Apparatus as claimed in claim 3 wherein the first waveguide probe is oriented to couple to a first primary coaxial waveguide mode of the coaxial waveguide cavity and is oriented substantially orthogonal to a TEM mode of the coaxial waveguide cavity.

5. Apparatus as claimed in claim 3 wherein the first waveguide probe extends through one of the outer conductor and the rear wall into the coaxial waveguide cavity.

6. Apparatus as claimed in claim 3 including in addition a second waveguide probe mounted within said coaxial waveguide cavity for exciting a second primary coaxial waveguide mode electromagnetic signal in the coaxial waveguide cavity, the second primary coaxial waveguide mode electromagnetic signal being substantially orthogonal to the first primary coaxial waveguide mode electromagnetic signal.

7. Apparatus as claimed in claim 6 wherein the second waveguide probe is oriented to couple to a second primary coaxial waveguide mode of the coaxial waveguide cavity and is oriented substantially orthogonal to a TEM mode of the coaxial waveguide cavity and the first waveguide probe.

8. Apparatus as claimed in claim 6 wherein the second waveguide probe extends through one of the outer conductor and the rear wall into the coaxial waveguide cavity.

9. Apparatus as claimed in claim 1 wherein the outer conductor and the center conductor are each substantially cylindrical.

10. Apparatus as claimed in claim 9 wherein cross-section of each of the outer conductor and the center conductor includes one of circular, square, and rectangular.

11. Dual waveguide feed apparatus for receiving or transmitting radio signals within dual ranges of frequencies including a lowest frequency, the apparatus comprising:

a waveguide having an open end and a rear wall opposite said open end positioned along an axis of the waveguide and defining a first waveguide cavity within the waveguide;

a center conductor positioned within said first waveguide cavity and along the axis of said waveguide, the center conductor defining a second waveguide cavity with a fundamental waveguide mode within the center conductor, the second waveguide cavity being constructed to operate at a first range of frequencies;

said center conductor and said waveguide defining a coaxial waveguide cavity with a fundamental coaxial-waveguide mode within the coaxial waveguide cavity, the coaxial waveguide cavity being constructed to operate at a second range of frequencies different than the first range of frequencies, and the waveguide being constructed to have a cutoff frequency for the fundamental coaxial-waveguide mode which is at least 95% of the lowest frequency for the apparatus; and a first waveguide probe mounted within said coaxial waveguide cavity so as to extend through one of the waveguide and the rear wall into the coaxial waveguide cavity for exciting a first primary coaxial waveguide mode electromagnetic signal in the waveguide cavity, the first waveguide probe being oriented to couple to a first primary coaxial waveguide mode of the coaxial waveguide cavity and being oriented substantially orthogonal to a TEM mode of the coaxial waveguide cavity.

12. Apparatus as claimed in claim 11 wherein the waveguide is constructed to have a cutoff frequency for the fundamental coaxial waveguide mode which is in a range of 100% to 200% of the lowest frequency for the apparatus.

13. Apparatus as claimed in claim 11 including in addition a second waveguide probe mounted within said coaxial waveguide cavity for exciting a second primary coaxial waveguide mode electromagnetic signal in the waveguide cavity, the second primary coaxial waveguide mode electromagnetic signal being substantially orthogonal to the first primary coaxial waveguide electromagnetic signal.

14. Apparatus as claimed in claim 13 wherein the second waveguide probe is oriented to couple to a second primary coaxial waveguide mode of the coaxial waveguide cavity and is oriented substantially orthogonal to the TEM mode of the coaxial waveguide cavity and the first waveguide probe.

15. Apparatus as claimed in claim 13 wherein the second waveguide probe extends through one of the waveguide and the rear wall into the coaxial waveguide cavity.

16. Dual waveguide feed apparatus for receiving or transmitting radio signals of C-Band frequencies, the apparatus comprising:

a waveguide having an open end and a rear wall opposite said open end positioned along an axis of the waveguide and defining a first waveguide cavity within the waveguide, said waveguide being constructed to have an inner diameter of less than 2 inches;

a center conductor positioned within said first waveguide cavity and along the axis of said waveguide, said center conductor defining a second waveguide cavity with a fundamental waveguide mode within the center conductor, the second waveguide cavity being constructed to operate at C-band frequencies;

said center conductor and said waveguide defining a coaxial waveguide cavity with a fundamental coaxial-waveguide mode within the coaxial waveguide cavity, the coaxial waveguide cavity being constructed to operate at a second range of frequencies different than the first range of frequencies; and a first waveguide probe mounted within said coaxial waveguide cavity so as to extend through one of the waveguide and the rear wall into the coaxial waveguide cavity for exciting a first primary coaxial waveguide mode electromagnetic C-Band frequency signal in the coaxial waveguide cavity, the first waveguide probe being oriented to couple to a first primary coaxial waveguide mode of the coaxial waveguide cavity and being oriented substantially orthogonal to a TEM mode of the coaxial waveguide cavity.

17. Apparatus as claimed in claim 16 wherein the waveguide is constructed to have an inner diameter in a range of 2 inches to 1 inch.

18. Apparatus as claimed in claim 16 including in addition a second waveguide probe mounted within said coaxial waveguide cavity so as to extend through one of the waveguide and the rear wall for exciting a second primary coaxial waveguide mode electromagnetic C-Band frequency signal in the coaxial waveguide cavity, the second primary coaxial waveguide mode electromagnetic C-Band frequency signal being orthogonal to the first primary coaxial waveguide electromagnetic C-Band frequency signal and to the TEM mode of the coaxial waveguide cavity.

19. Apparatus as claimed in claim 16 wherein the center conductor includes a second waveguide defining a second waveguide cavity therein.

20. Apparatus as claimed in claim 19 wherein the second waveguide and the second waveguide cavity therein are constructed to propagate Ku-Band frequencies in a primary waveguide mode.

* * * * *